US007156783B2

(12) United States Patent
Chen

(10) Patent No.: US 7,156,783 B2
(45) Date of Patent: Jan. 2, 2007

(54) EXERCISE BENCH AND DUMBELL COMBINATION

(76) Inventor: Paul Chen, 7771 Goldstream Dr., Richmond, Vancouver, BC (CA) V7A 1S5

( * ) Notice: Subject to any disclaimer, the term of this patent is extended or adjusted under 35 U.S.C. 154(b) by 593 days.

(21) Appl. No.: 10/613,569

(22) Filed: Jul. 3, 2003

(65) Prior Publication Data

US 2005/0003937 A1 Jan. 6, 2005

(51) Int. Cl.
*A63B 21/078* (2006.01)

(52) U.S. Cl. ..... 482/104; 482/94

(58) Field of Classification Search ..... 482/97–100, 482/104, 106–108, 142
See application file for complete search history.

(56) References Cited

U.S. PATENT DOCUMENTS 4,691,916 A 9/1987 Voris ..... 272/118
5,472,397 A * 12/1995 Ammoscato et al. ..... 482/104
5,603,682 A * 2/1997 Grider ..... 482/142
6,287,243 B1 * 9/2001 Isom et al. ..... 482/142
6,447,433 B1 * 9/2002 Reyes ..... 482/104

FOREIGN PATENT DOCUMENTS

SU 1618430 A * 1/1991

* cited by examiner

*Primary Examiner*—Jerome Donnelly
*Assistant Examiner*—Fenn C. Mathew
(74) *Attorney, Agent, or Firm*—Charles E. Baxley

(57) ABSTRACT

An exercise bench and dumbbell combination includes a base having a bench member for supporting users, a shelf supported on the base, and a dumbbell device supported on the shelf and arranged to be easily obtained or fetched by the users. The shelf is preferably rotatably secured on the base with a pivot rod, to allow the shelf and the dumbbell device to be rotated relative to the base to any suitable positions. The dumbbell device includes a number of weights to be selectively secured or coupled to the handgrip. A cushion may be adjustably attached the base with an arm to suitably support the users.

13 Claims, 9 Drawing Sheets

EXERCISE BENCH AND DUMBELL COMBINATION

BACKGROUND OF THE INVENTION

1. Field of the Invention

The present invention relates to an exercise bench and dumbbell, and more particularly to an exercise bench and dumbbell combination for allowing users to easily use either or both the exercise bench and the dumbbell device.

2. Description of the Prior Art

Typical exercise benches or apparatus may comprise a bench member to support the users, and a trolley device attached to the bench member and having a weight stack for allowing the users to conduct weight lifting or training exercises.

U.S. Pat. No. 4,691,916 to Voris discloses one of the typical exercise benches or apparatus including a trolley device attached to the bench member and having a weight stack provided therein. The users may lie on the bench member, and may hold and pull a handle member to move or lift the weight stack up and down, and to conduct weight lifting or training exercises.

However, the weight stack normally includes a heavy weight that may not be easily operated by various kinds of persons. In addition, the weight stack is slidably positioned in a frame, and may not be easily moved to the other places or positions, and thus may not be easily operated by the users.

The typical dumbbell devices may be easily moved to the other places or positions, and thus may be easily operated by the users at any place or position.

When the users would like to exercise with both the exercise benches and the dumbbell devices, the users may have to purchase both the exercise benches and the dumbbell devices. In addition, the typical exercise benches do not provide any support members to support the dumbbell devices, and may have to prepare or purchase additional stools or desks to support the dumbbell devices. It is thus difficult or inconvenient for the users to exercise with both the exercise benches and the dumbbell devices.

The present invention has arisen to mitigate and/or obviate the afore-described disadvantages of the conventional exercise bench and dumbbell combinations.

SUMMARY OF THE INVENTION

The primary objective of the present invention is to provide an exercise bench and dumbbell combination for allowing the users to easily use either or both the exercise bench and the dumbbell device.

The other objective of the present invention is to provide an exercise bench and dumbbell combination including an adjustable dumbbell device for allowing the users to easily use or operate either of the weight members of the dumbbell device.

In accordance with one aspect of the invention, there is provided an exercise bench and dumbbell combination comprising a base including a bench member supported thereon for supporting users thereon, a shelf supported on the base, and an adjustable dumbbell device supported on the shelf and arranged to be fetched by the users.

The shelf is rotatably secured on the base with a pivot rod, to allow the shelf and the adjustable dumbbell device to be rotated relative to the base to suitable positions. The shelf includes a recess formed therein to support the adjustable dumbbell device.

The shelf includes a pair of bulges provided thereon and each having a plurality of depressions formed therein, the adjustable dumbbell device includes a plurality of weight members received and seated in the depressions of the shelf. The shelf includes a plate attached to bottom and rotatably secured on the base with the pivot rod.

A cushion may further be provided and selectively attached to the base. An arm may further be provided and attached to the base, to support the cushion. The arm includes a first end attached to the base, and a second end attached to the cushion.

A device may further be provided for adjustably securing the first end of the arm to the base, and includes a post secured on the base, a block disposed on the post, a plurality of orifices formed in the block, an extension extended from the first end of the arm, and a latch pin engageable through the extension of the arm and selectively engaged through either of the orifices of the block, to secure the arm to the block at selected angular positions.

Another device may further be provided and for adjustably securing the second end of the arm to the cushion, and includes a flap attached to the cushion and having a plurality of apertures formed therein, and a latch pin engageable through the flap of the cushion and selectively engaged through either of the apertures of the flap, to secure the cushion to the arm at selected angular positions.

The adjustable dumbbell device includes a plurality of weight members each having a channel formed therein, a hand grip having at least one end engaged through the channel of the weight members, and a securing device for selectively securing the weight members to the end of the hand grip.

The end of the handgrip includes a slot formed therein, the selectively securing device includes a latch member slidably engaged through the slot of the hand grip and engageable with selected number of the weight members.

The selectively securing device includes a fastener secured on the latch member, and a catch slidably engaged on the fastener, and engageable with the end of the handgrip, to secure the end of the handgrip and the latch member and the selected number of the weight members together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
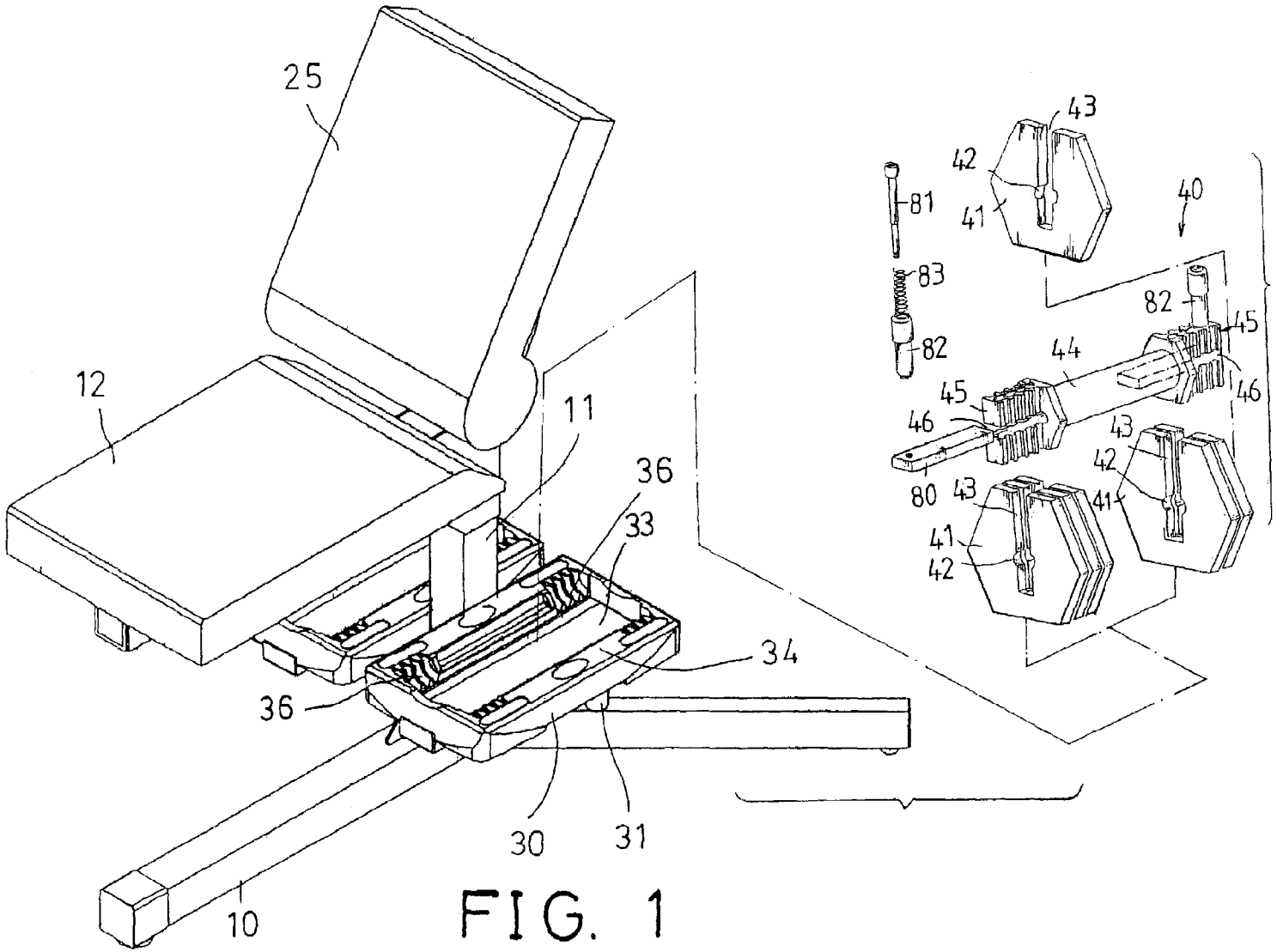
FIG. 1 is a partial exploded view of an exercise bench and dumbbell combination in accordance with the present invention.

Referring to the drawings, and initially to FIGS. 1–8, an exercise bench and dumbbell combination in accordance with the present invention comprises a base 10 including a post 11 secured thereon or extended upwardly therefrom, and a bench member 12 disposed or provided on top of the post 11, to support users. For example, the post 11 includes a block 13 disposed on top thereof to attach or to support the bench member 12 thereon.

Figure 6:
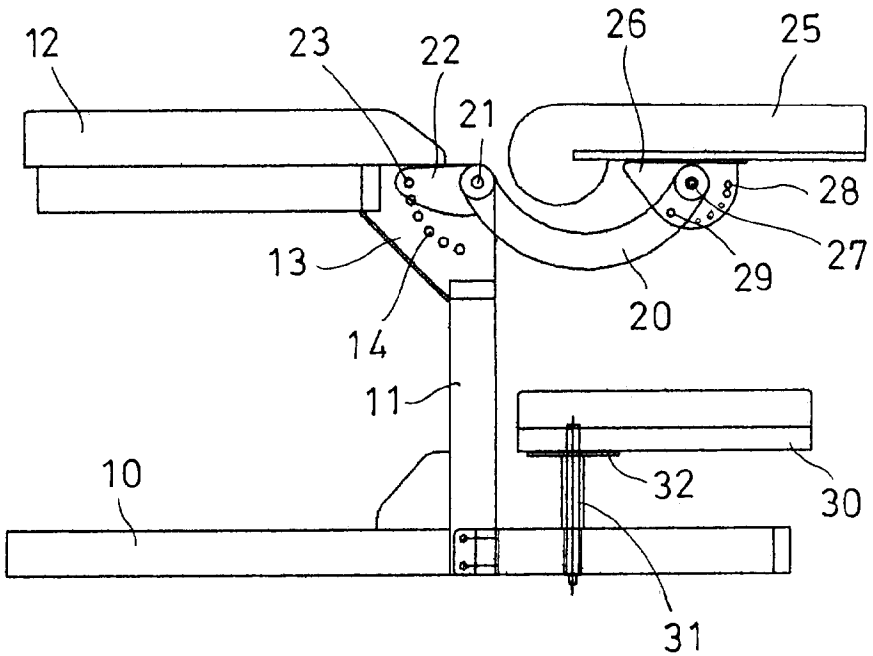
FIGS. 5, 6, 7 are side schematic views illustrating the folding operation of the exercise bench member of the bench and dumbbell combination.
Figure 5:
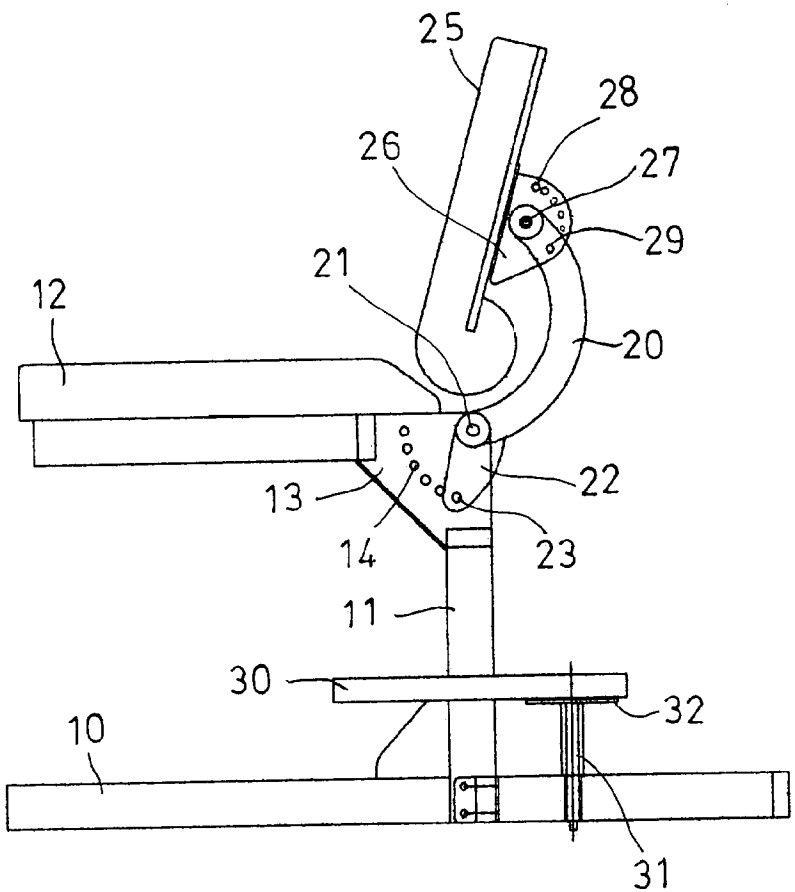
Figure 7:
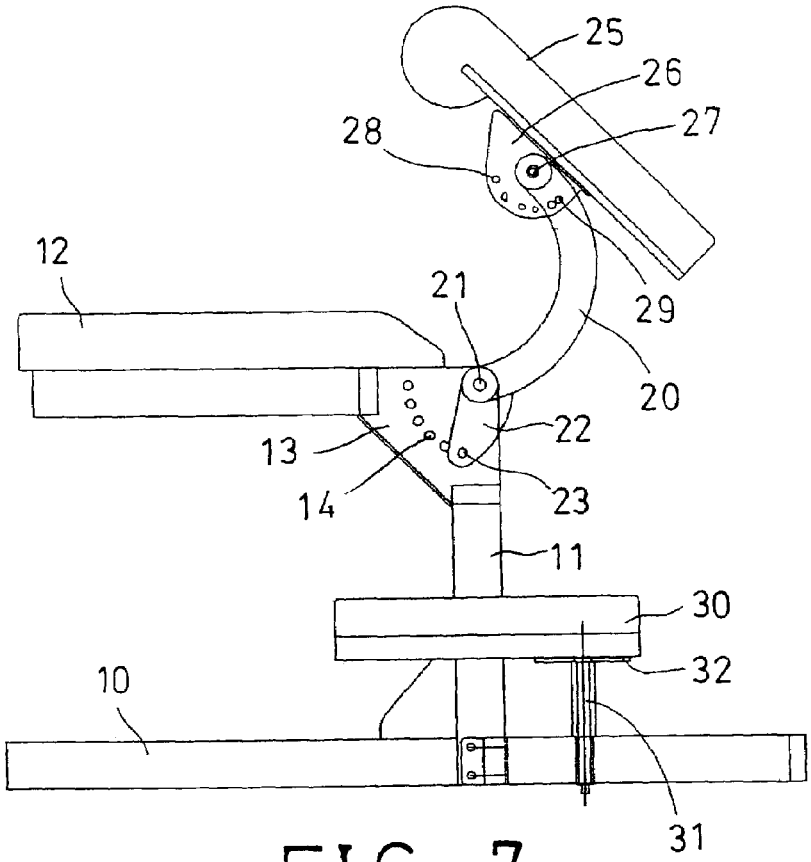
Figure 8:
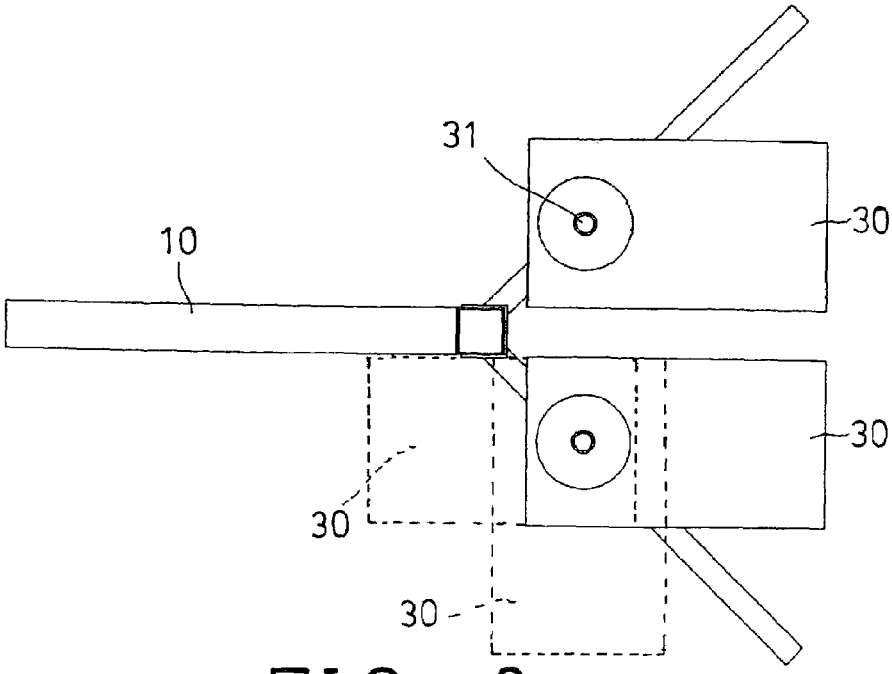
FIG. 8 is a top plan schematic view illustrating the operation of the exercise bench and dumbbell combination.
Figure 9:
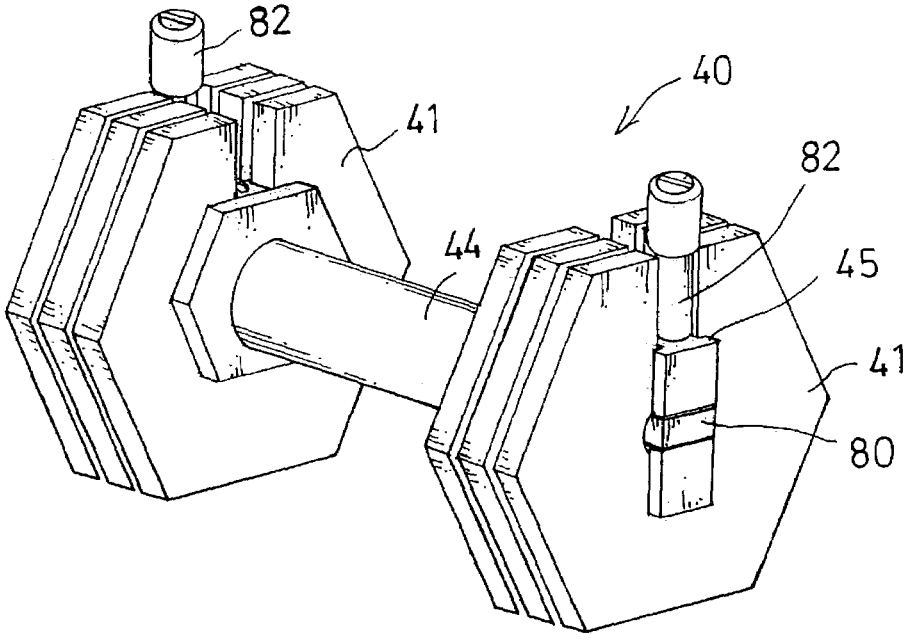
FIG. 9 is a perspective view of the dumbbell device of the exercise bench and dumbbell combination.
Figure 11:
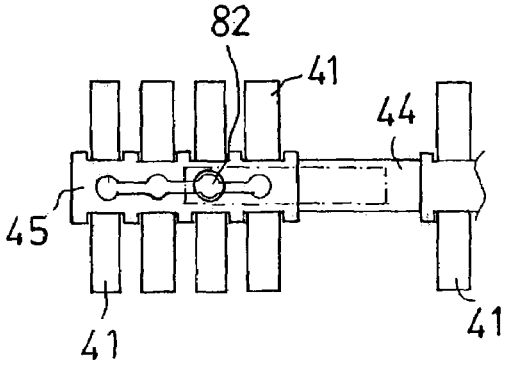
FIGS. 10 and 11 are top plan schematic views illustrating the adjustment of the dumbbell device.
Figure 10:
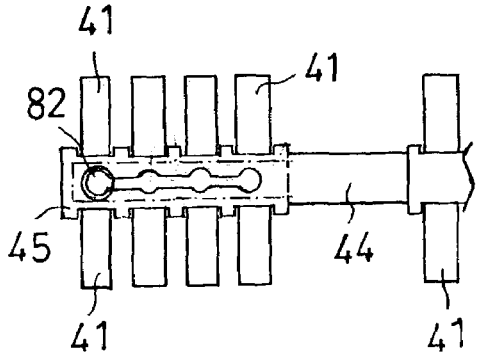

An arm 20 includes one end rotatably or pivotally secured to the post 11 or to the block 13 with a pivot shaft 21, to allow the arm 20 to be rotated relative to the post 11 or the base 10 about the pivot shaft 21 (FIGS. 5–7). The block 13 includes a number of orifices 14 formed therein, and arranged around the pivot shaft 21. The arm 20 includes an extension 22 extended therefrom and selectively or adjustably secured to the block 13 at different angular positions (FIGS. 5–7).

For example, a fastener or latch pin 23 may be engaged through the extension 22 of the arm 20, and selectively engaged through either of the orifices 14 of the block 13, to secure and maintain the arm 20 to the block 13 or the base 10 at different angular positions. A cushion 25 may be attached or supported on the other end of the arm 20, to support the users.

For example, the cushion 25 may be rotatably attached to the other end of the arm 20 with a pivot axle 27, and/or may include a flap 26 rotatably attached to the arm 20 with the pivot axle 27. The flap 26 of the cushion 25 may include one or more apertures 28 formed therein to receive another fastener or latch pin 29 which may be engaged through the arm 20, to adjustably secure and maintain the cushion 25 to the arm 20 at different angular positions.

A shelf 30 may further be provided and supported on the base 10 with a rod 31 to support various dumbbell devices 40 as shown in FIGS. 1–8. For example, the shelf 30 includes a plate 32 rotatably or pivotally secured or supported on the base 10 with the pivot rod 31, to support the dumbbell devices 40 thereon.

For example, the shelf 30 includes a recess 33 formed therein and defined by a pair of bulges 34 each of which includes a number of depressions 36 formed therein, to receive and support the weight members or heads 41 of the dumbbell device 40. The shelf 30 that supports the dumbbell devices 40 may be rotated relative to the base 10 about the pivot rod 31, to rotate the dumbbell devices 40 to suitable positions that allow users to easily obtain or fetch the dumbbell device 40.

The dumbbell devices 40 those have been purchased by the users may also be selectively disposed on the shelf 30. The provision of the shelf 30 on the base 10 may suitably support the dumbbell devices 40 at suitable positions to allow the users to easily obtain or fetch and operate the dumbbell devices 40.

Figure 2:
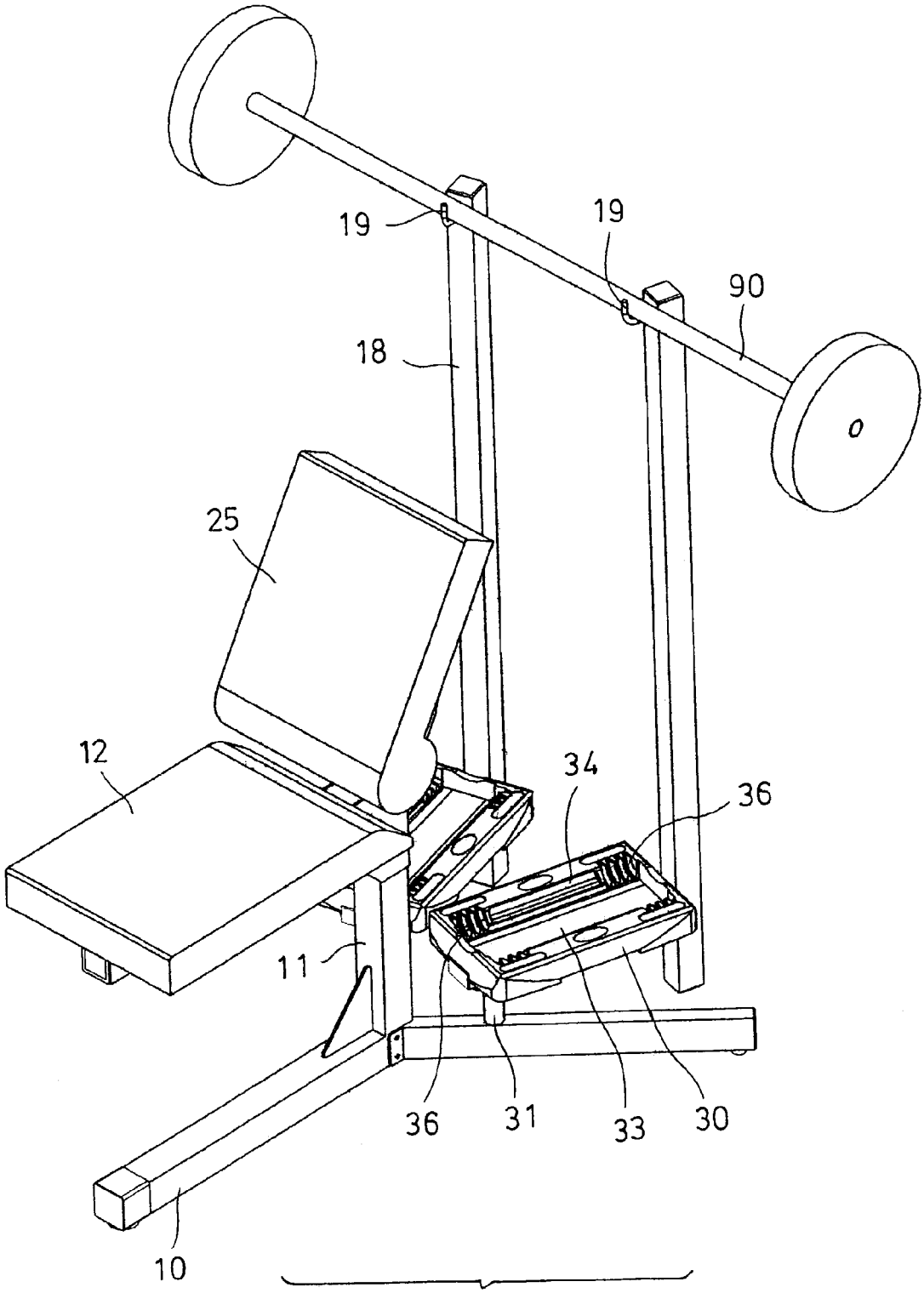
FIGS. 2, 3, 4 are perspective views illustrating the folding operation of the exercise bench member of the bench and dumbbell combination.
Figure 3:
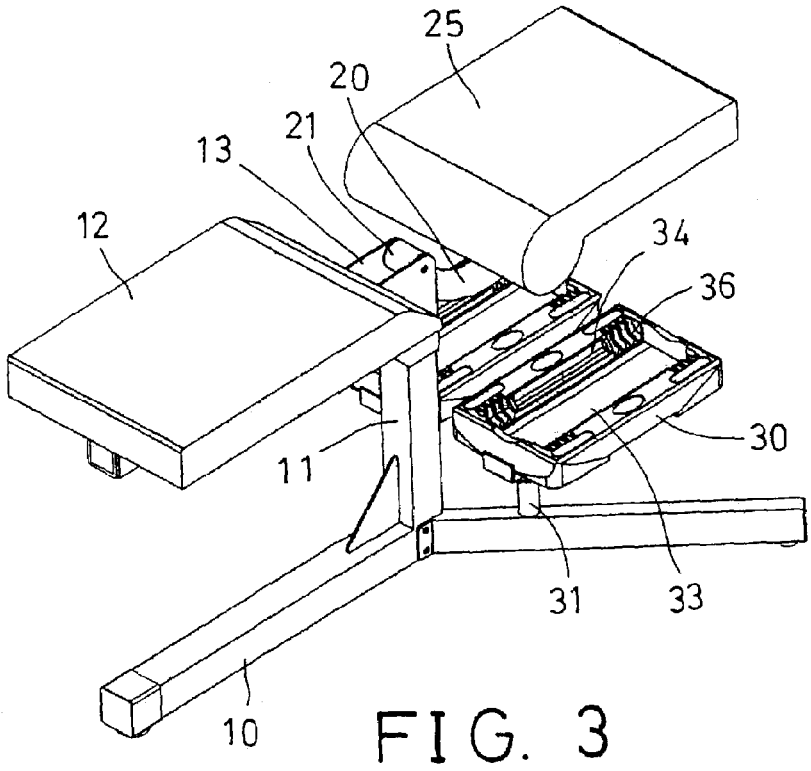
Figure 4:
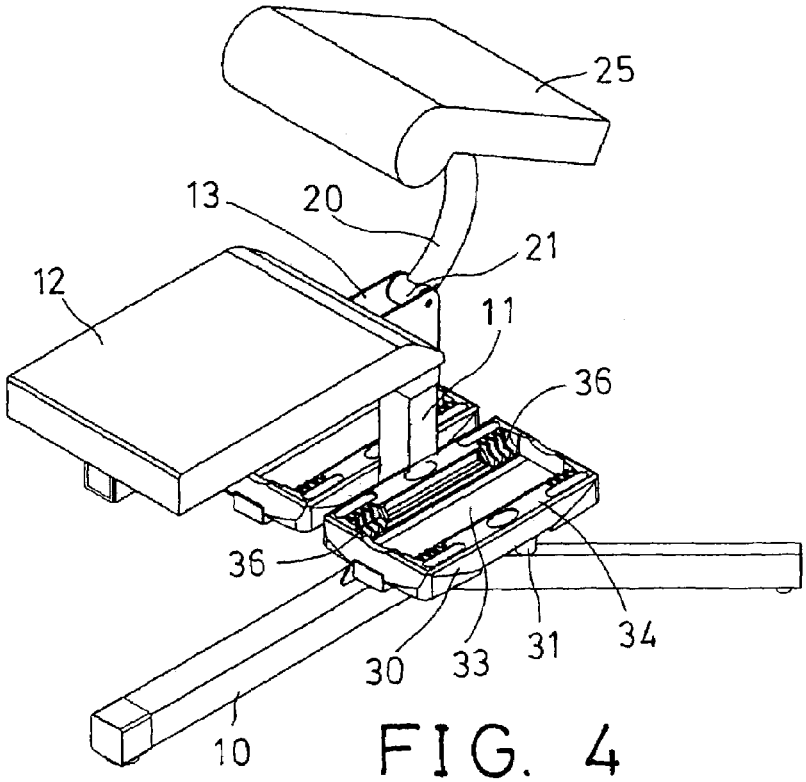

As shown in FIG. 2, a stand 18 may further be provided and disposed beside or on the base 10, and may include one or more hooks 19 to support the other weight lifting members or dumbbells 90.

As shown in FIGS. 1 and 9–11, the dumbbell device 40 may include a number of weight members 41 each having a channel 42 and a groove 43 formed therein and communication with each other, a hand grip 44 having two ends 45 engageable through the channels 42 of the weight members 41 respectively. Each of the ends 45 of the hand grip 44 includes a slot 46 formed therein to slidably receive a latch member 80 therein. The latch member 80 may be moved relative to the hand grip 44 and the weight members 41, to engage with selected number of the weight members 41.

A pole or fastener 81 may be secured to the latch member 80, and a catch 82 is slidably engaged on the fastener 81, and biased to engage with the respective ends 45 of the hand grip 44, to selectively secure the latch member 80 to one or more of the weight members 41, and thus to selectively secure the weight members 41 to the hand grip 44.

One example of the adjustable dumbbell devices 40 has been disclosed and filed in a co-pending U.S. patent application Ser. No. 09/867,509 on 31 May 2001, which is taken as a reference for the present invention.

Figure 12:
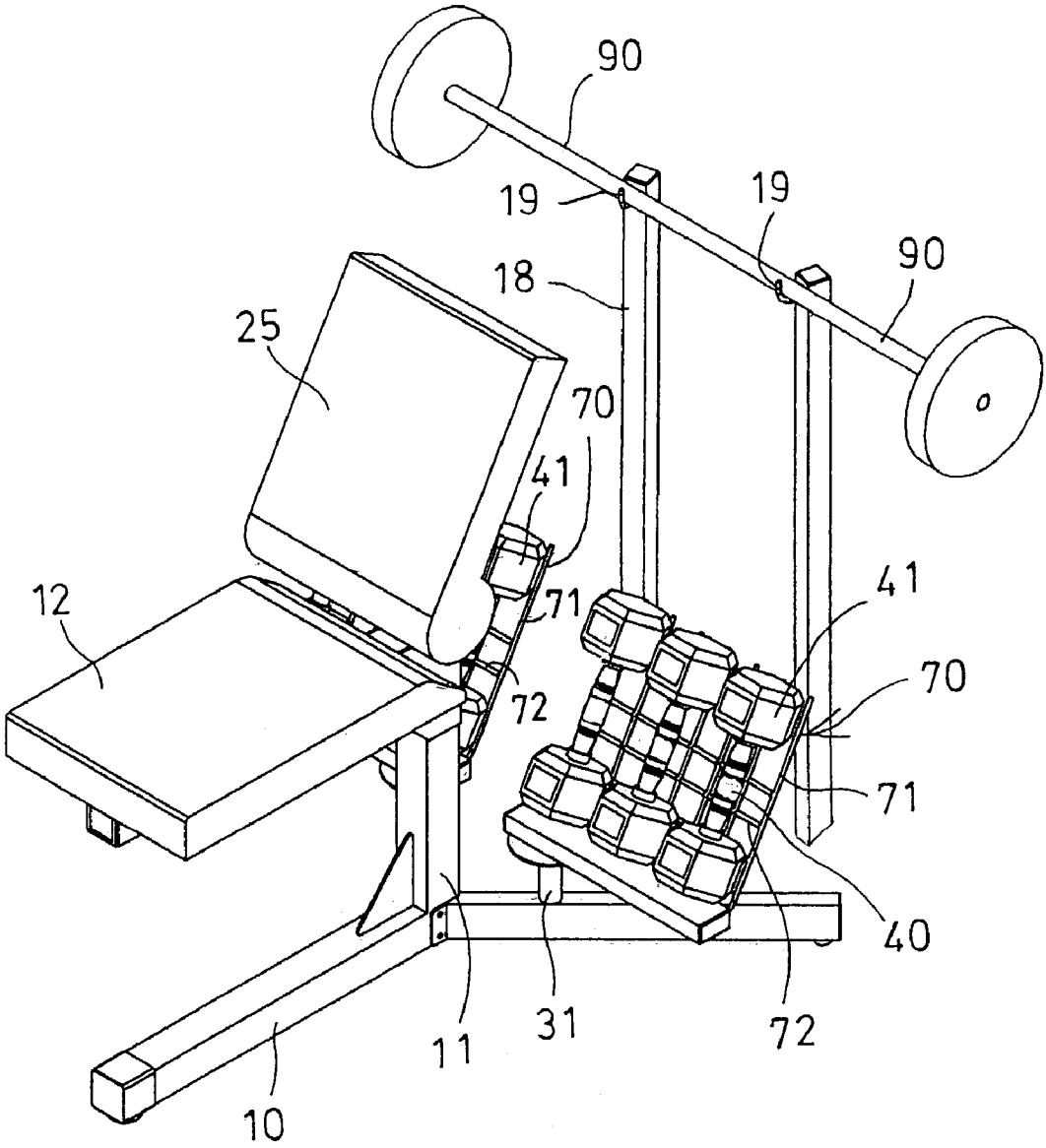
FIG. 12 is a perspective view illustrating another dumbbell device of the exercise bench and dumbbell combination.
Figure 13:
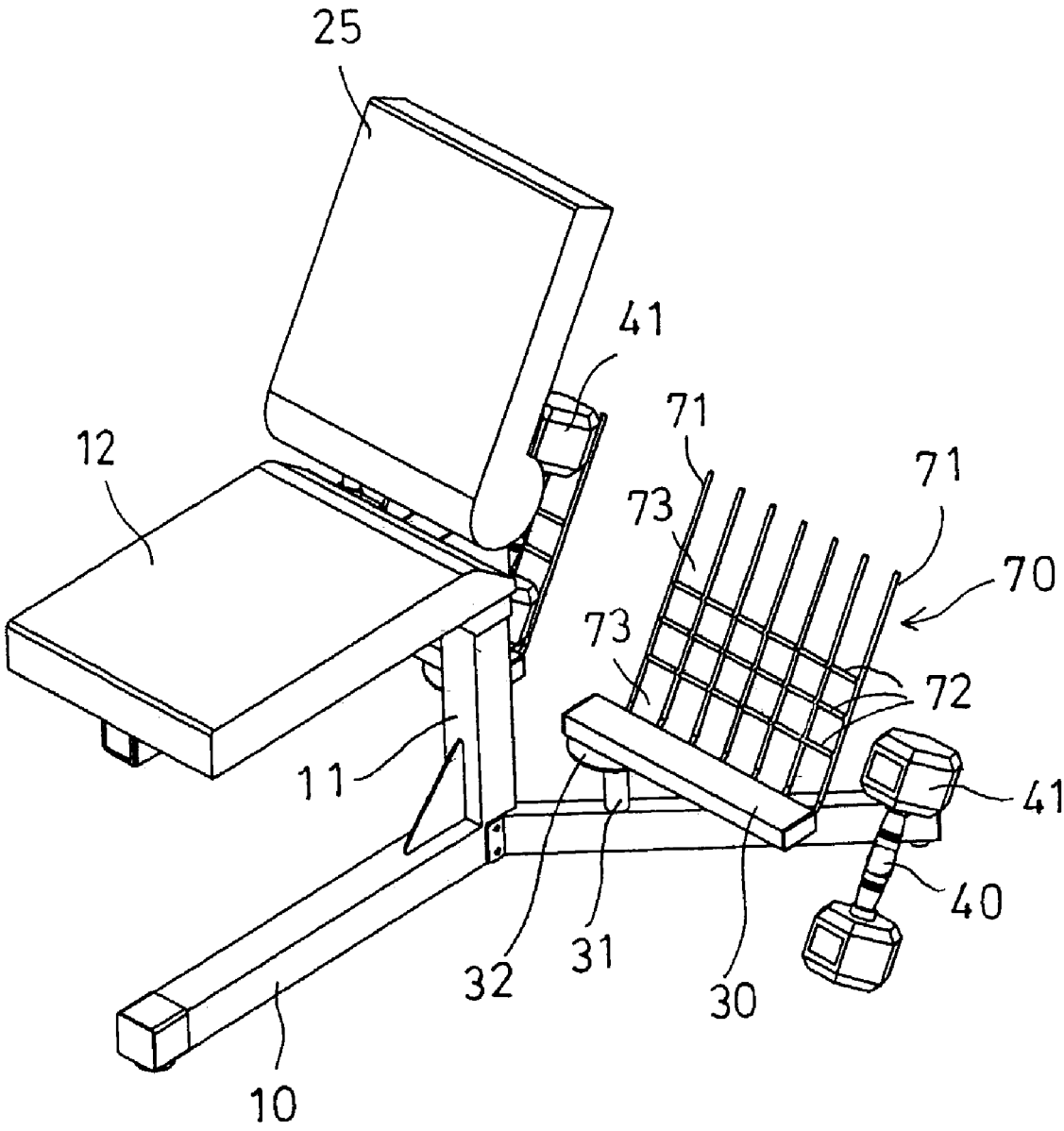
FIG. 13 is a partial exploded view of the exercise bench and dumbbell combination as shown in FIG. 12.
Figure 15:
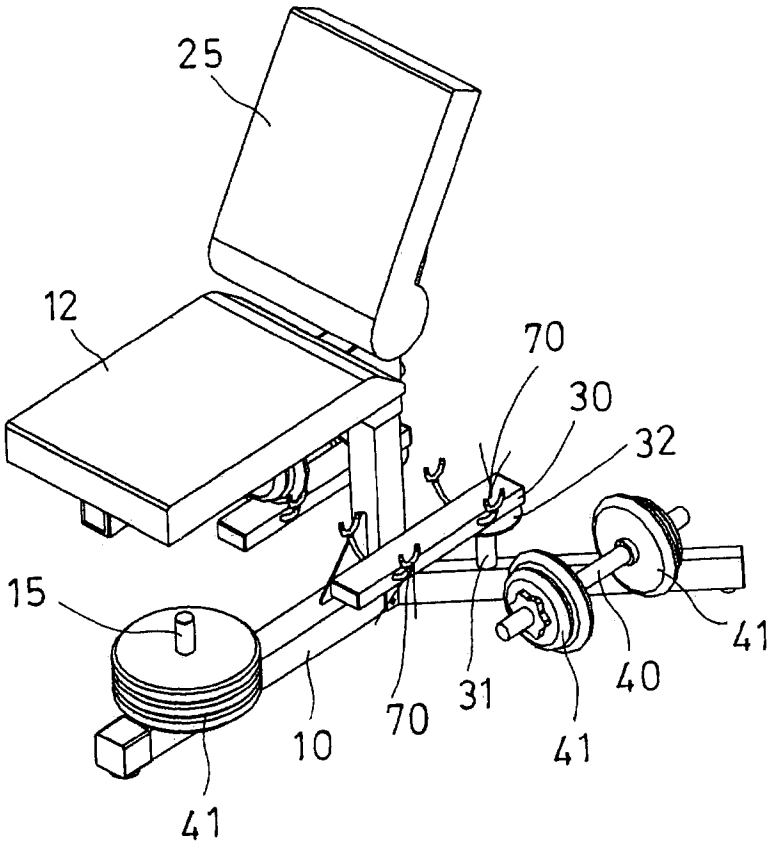
FIG. 15 is a partial exploded view of the exercise bench and dumbbell combination as shown in FIG. 14.
Figure 14:
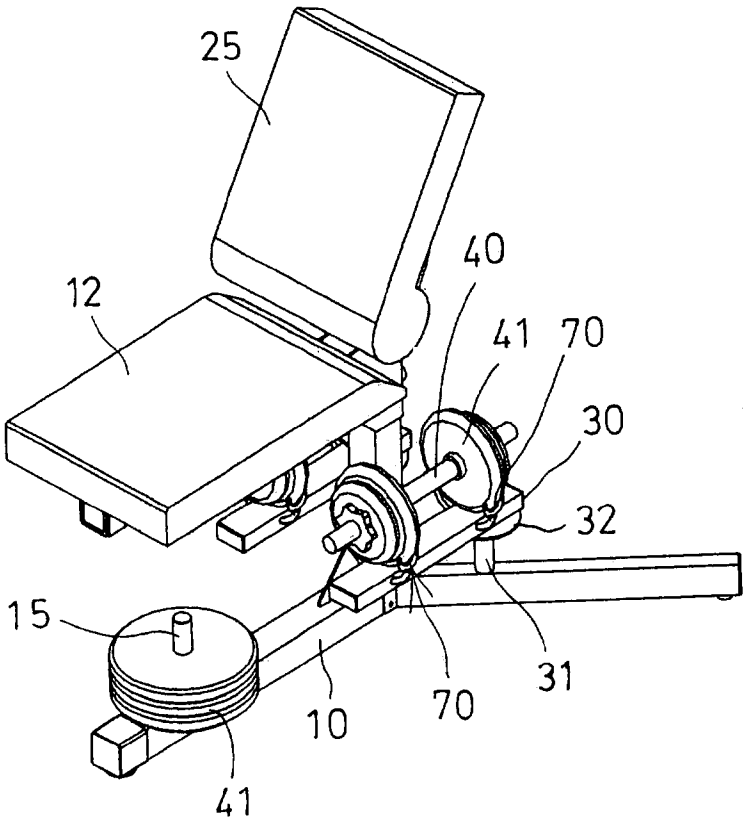
FIG. 14 is a perspective view illustrating a further dumbbell device of the exercise bench and dumbbell combination.

As shown in FIGS. 12–15, a frame 70 may further be provided or attached or disposed on the shelf 30 to support the dumbbell devices 40. For example, as shown in FIGS. 12–13, the frame 70 includes a spider structure having a number of longitudinal wires 71 and a number of lateral wires 72 secured together, to form a number of openings or recesses 73 therein, and to receive and support the weight members or heads 41 of the dumbbell devices 40. The frame 70 may also include a curved or hook structure to receive and support the weight members or heads 41 of the dumbbell devices 40 (FIGS. 14–15).

Accordingly, the exercise bench and dumbbell combination in accordance with the present invention may be provided for allowing the users to easily use either or both the exercise bench and the typical dumbbell device or the adjustable dumbbell device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise bench and dumbbell combination comprising:

a base including a bench member supported thereon for supporting users thereon, a shelf supported on said base and including a recess formed therein, and including a pair of bulges provided thereon and each having a plurality of depressions formed therein, and a dumbbell device supported on said recess of said shelf and arranged to be fetched by the users, and said dumbbell device including a plurality of weight members received and seated in said depressions of said shelf.

2. The exercise bench and dumbbell combination as claimed in claim 1, wherein said shelf is rotatably secured on said base with a pivot rod, to allow said shelf and said dumbbell device to be rotated relative to said base to suitable positions.

3. The exercise bench and dumbbell combination as claimed in claim 1 further comprising a cushion selectively attached to said base.

4. The exercise bench and dumbbell combination as claimed in claim 3 further comprising an arm attached to said base, to support said cushion.

5. The exercise bench and dumbbell combination as claimed in claim 4, wherein said arm includes a first end attached to said base, and a second end attached to said cushion.

6. The exercise bench and dumbbell combination as claimed in claim 5 further comprising means for adjustably securing said first end of said arm to said base.

7. The exercise bench and dumbbell combination as claimed in claim 5 further comprising means for adjustably securing said second end of said arm to said cushion.

8. The exercise bench and dumbbell combination as claimed in claim 7, wherein said adjustably securing means includes a flap attached to said cushion and having a plurality of apertures formed therein, and a latch pin engageable through said flap of said cushion and selectively engaged through either of said apertures of said flap, to secure said cushion to said arm at selected angular positions.

9. The exercise bench and dumbbell combination as claimed in claim 1, wherein said dumbbell device includes a plurality of weight members each having a channel formed therein, a hand grip having at least one end engaged through said channel of said weight members, and means for selectively securing said weight members to said at least one end of said hand grip.

10. The exercise bench and dumbbell combination as claimed in claim 9, wherein said at least one end of said hand grip includes a slot formed therein, said selectively securing means includes a latch member slidably engaged through said slot of said hand grip and engageable with selected number of said weight members.

11. An exercise bench and dumbbell combination comprising:

a base including a bench member supported thereon for supporting users thereon, a shelf rotatably supported on said base with a pivot rod, and a dumbbell device supported on said shelf and arranged to be fetched by the users, to allow said shelf and said dumbbell device to be rotated relative to said base, and said shelf including a plate attached to bottom and rotatably secured on said base with said pivot rod.

12. An exercise bench and dumbbell combination comprising:

a base including a bench member supported thereon for supporting users thereon, a shelf supported on said base, a dumbbell device supported on said shelf and arranged to be fetched by the users, an arm including a first end attached to said base, and including a second end, a cushion selectively attached to said second end of said arm, and means for adjustably securing said first end of said arm to said base said adjustably securing means including a post secured on said base, a block disposed on said post, a plurality of orifices formed in said block, an extension extended from said first end of said arm, and a latch pin engageable through said extension of said arm and selectively engaged through either of said orifices of said block, to secure said arm to said block at selected angular positions.

13. An exercise bench and dumbbell combination comprising:

a base including a bench member supported thereon for supporting users thereon, a shelf supported on said base, and a dumbbell device supported on said shelf and arranged to be fetched by the users, said dumbbell device including a plurality of weight members each having a channel formed therein, a hand grip having at least one end engaged through said channel of said weight members, said at least one end of said hand grip including a slot formed therein, and means for selectively securing said weight members to said at least one end of said hand grip, said selectively securing means including a latch member slidably engaged through said slot of said hand grip and engageable with selected number of said weight members, and said selectively securing means including a fastener secured on said latch member, and a catch slidably engaged on said fastener, and engageable with said at least one end of said hand grip, to secure said at least one end of said hand grip and said latch member and said selected number of said weight members together.

* * * * *